United States Patent [19]

Mongelli

[11] Patent Number: 4,509,630

[45] Date of Patent: Apr. 9, 1985

[54] MULTI-COIN COIN CHUTE

[76] Inventor: Julio Mongelli, 96 Roehrs Dr., Wallington, N.J. 07057

[21] Appl. No.: 386,117

[22] Filed: Jun. 7, 1982

[51] Int. Cl.[3] ..... G07F 5/06

[52] U.S. Cl. ..... 194/1 G; 194/102

[58] Field of Search ..... 194/1 G, DIG. 2, 99, 194/102, 54, 55, 57, 58, 92, 1 E

[56] References Cited

U.S. PATENT DOCUMENTS

| | | | |
|---|---|---|---|
| 3,031,055 | 4/1962 | Soule | 194/DIG 4 |
| 3,361,241 | 1/1968 | Hall | 194/1 G |
| 3,978,960 | 9/1976 | Mellinger et al. | 194/102 |
| 4,214,654 | 7/1980 | Pryor | 194/1 E |

*Primary Examiner*—Stanley H. Tollberg
*Attorney, Agent, or Firm*—Alfred E. Riccardo

[57] ABSTRACT

An improved coin chute for actuating commercial coin operated machines such as clothes washers and dryers wherein up to ten coins or more can be inserted simultaneously. The coins are measured for acceptability and, if accepted, are transferred to the coin receptacle in a smooth motion without having the coins internally block the mechanism. Acceptance or rejection of the coins occurs without the coins having left the sight of the user. Certain price changes can be accomplished without replacing any components, and several different price levels can be set externally to achieve different desired modes of machine operation.

7 Claims, 11 Drawing Figures

FIG. 8
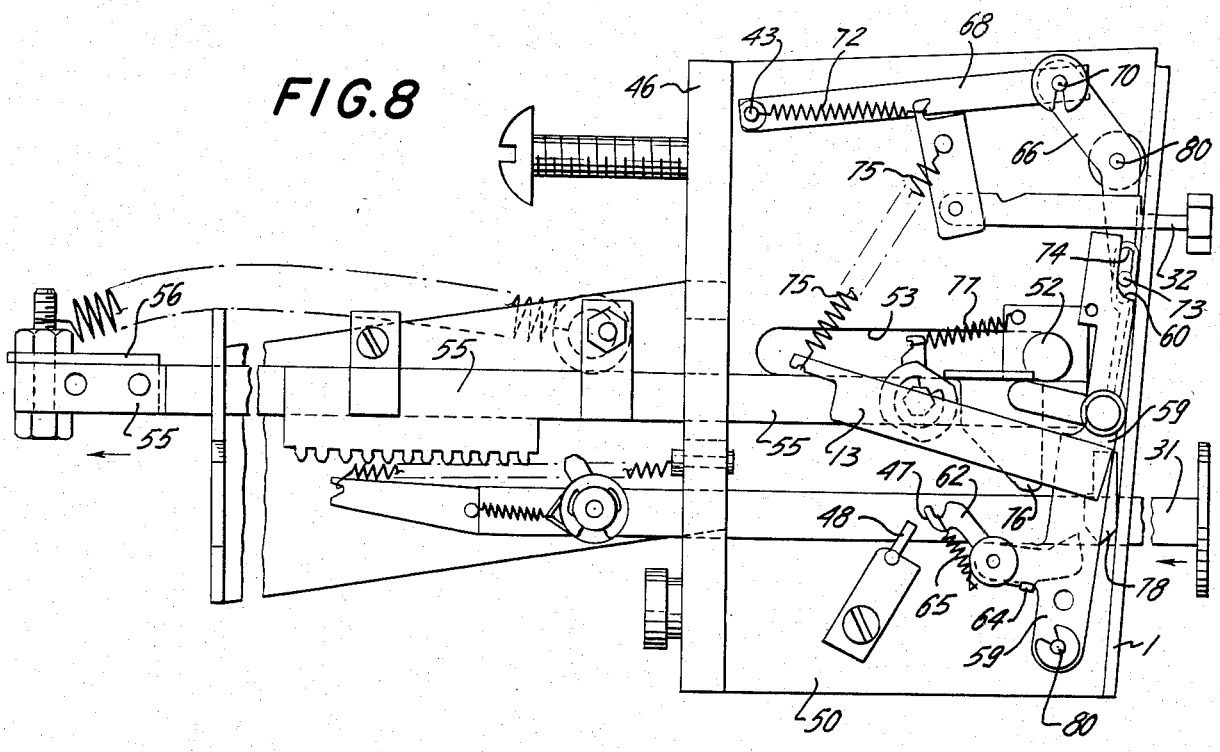
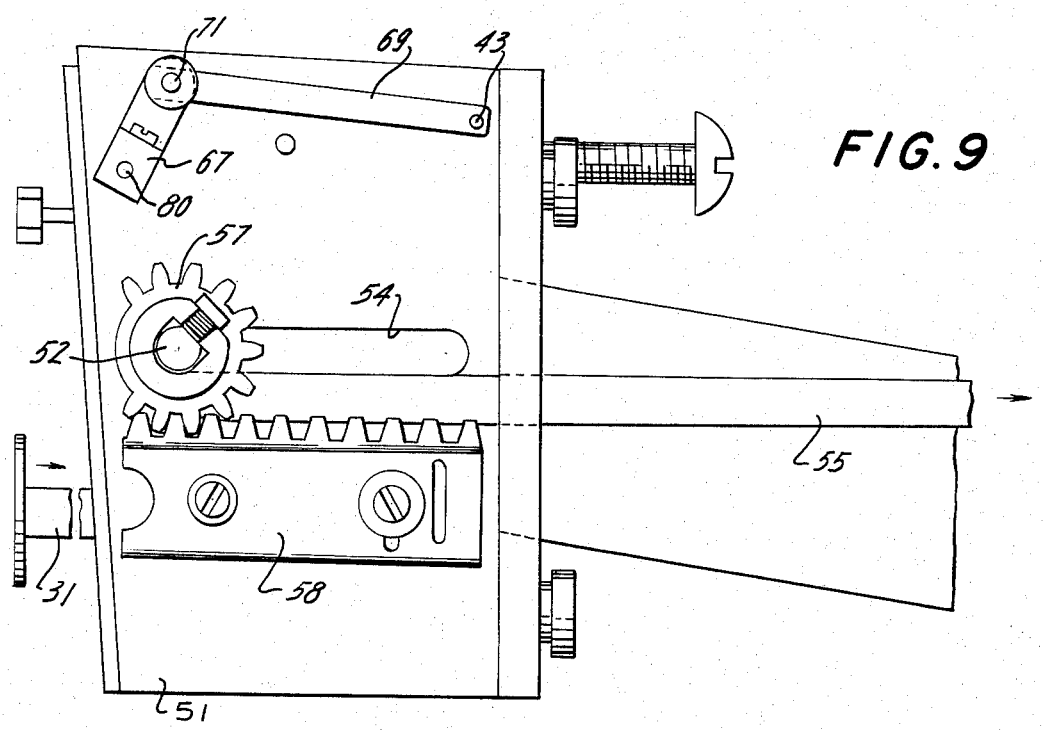
FIG. 9

MULTI-COIN COIN CHUTE

FIELD OF THE INVENTION

This invention relates to an improvement in coin chutes used to actuate commercial machines such as clothes washers or dryers or any machine that dispenses a product or service through the actuation of a coin chute. This coin chute, built to fit into the existing housings on the machines to be actuated, can accomodate up to ten coins or more simultaneously of the same or different denominations in any combination.

DESCRIPTION OF THE PRIOR ART

Coin chutes are used to actuate the timing cycles on machines such as clothes washers and dryers in commercial laundromats, etc. The chutes are constructed to fit into existing housings on the machine, collect the coins, discriminate acceptable coins from slugs ("Calipering"), transfer the coins to a coin receptacle in the machine and actuate the timing cycle; thus operating the machine.

In the prior art there are numerous types of coin chutes. The one described in U.S. Pat. No. 3,489,259 fulfills its basic functions of accepting a set amount of coins and actuating the machine, but it requires skilled intervention to accomodate a different set amount of coins. Usually this is done by returning the coin chute to the manufacturer. U.S. Pat. No. 3,763,948 improves on that design by providing easily adjustable dogs to permit accomodation of limited sets of different coins. The vending machine owner must still make internal adjustments.

U.S. Pat. No. 4,221,285 allows the changing of the vending amount by selectively removing press-fitted knockout plugs in the slide or replacing the slide. All of these units in the prior art have slides which linearly translate the coins into the coin housing with the calipering done by internal sizing dogs using the coins as the means to neutralize these obstructions built into the path of the slide. The biggest problem with this system is that too many times after blocking or jamming, the slide does not unblock or unjam without requiring skilled intervention by a serviceman to unjam the chute. In the meantime the machine is inoperable and any attempt by the user to unjam the chute so he can retrieve his money often results in damage to internal components.

It is an object of the present invention to provide a coin chute with a large built-in price change capability to allow the owner to simply set increased prices to keep up with inflation. A further object is to permit operation of the chute smoothly, with very little force regardless of the number of coins used while protecting the integrity of the chute from the abuses of the user even when the coins are rejected.

SUMMARY OF THE INVENTION

In accordance with the invention, the foregoing object, and others, as will become apparent in the course of the ensuing specification, are achieved in a coin chute that differs substantially from the concepts of the prior art. The improvement comprises a coin housing having a multiplicity of coin receiving slots up to ten or more allowing the setting of any desired amount from five cents to ten dollars or more. The coin receiving slots caliper the coins which are then transferred to a coin receptacle in the machine. Simultaneously the basic machine is actuated.

In accordance with another aspect of the present invention, the "calipering" acceptance or rejection of the coins can be accomplished by measurement of the diameter and thickness of the coins. The coin receiving slots in the coin housing can have fixed lower "vee" shaped guides, side walls, and pivoted upper "vee" guides. The sensor only actuates when correctly sized coins position the pivoted upper "vee" guides.

The transference of the coins can be accomplished by having the coin housing pivotally mounted on a movable frame thus allowing the calipered coins and the housing to linearly translate and rotate about the pivot and have the coins then fall into the coin receptacle by gravity.

For a better understanding of the present invention together with other and further objects thereof, reference is had to the following description taken in connection with the accompanying drawings, while its scope will be pointed out in the appended claims.

BRIEF DESCRIPTION OF THE DRAWINGS

The invention is diagrammatically illustrated, by way of example, in the drawings appended hereto, in which:

FIG. 8 is a side elevational view of the left hand side of the coin shute.

FIG. 9 is a side elevational view of the right side of the coin chute.

DESCRIPTION OF THE PREFERRED EMBODIMENT

Figure 1:
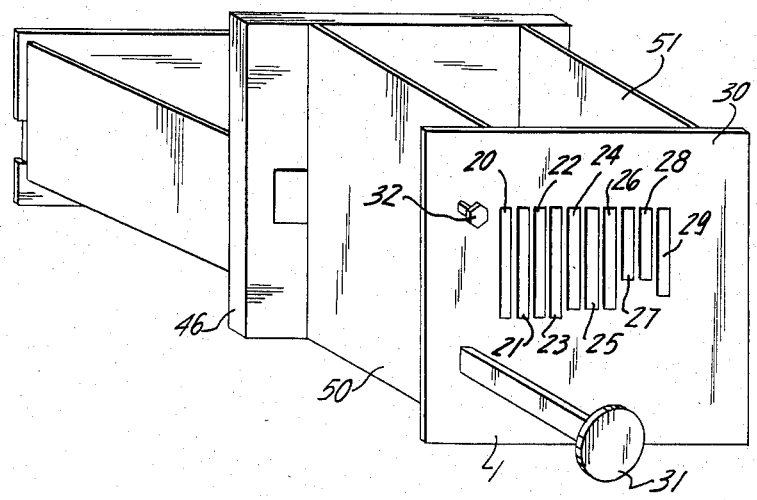
FIG. 1 is a perspective view of the coin chute illustrating where coins are inserted and the operators for machine actuation or coin retrieval.

In FIG. 1 herein a highly perspective view of the coin chute, there is illustrated the coin receiving openings 20 through 29, which in the original prototype, openings 20, 21, 22, and 23 were constructed to accept Susan B. Anthony one (1) dollar coins; openings 24, 25, and 26 were constructed to accept quarters; slots 27 and 28 were constructed to accept dimes; and slot 29 to accept a nickle; thereby allowing any desired set combination from five cents to five dollars in five cent intervals. By adding more slots and changing the denominations of the coins for the slots, an amount exceeding ten dollars could be set for actuation. When the required coins are inserted, plunger 31 is pushed. If the coins are acceptable, the coins will enter into the internal section of the chute and the machine will be actuated. If not all the required coins are present or if the coins are not legitimate as determined by the calipering, the coins will remain in the user's view and the machine will not actuate. Lever 32 can then be pushed releasing the coins to the user.

Figure 2:
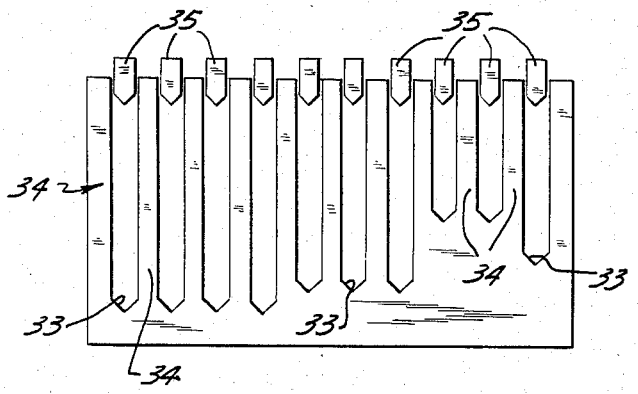
FIG. 2 is a representational front view of the coin housing with the front plate removed.
Figure 3:
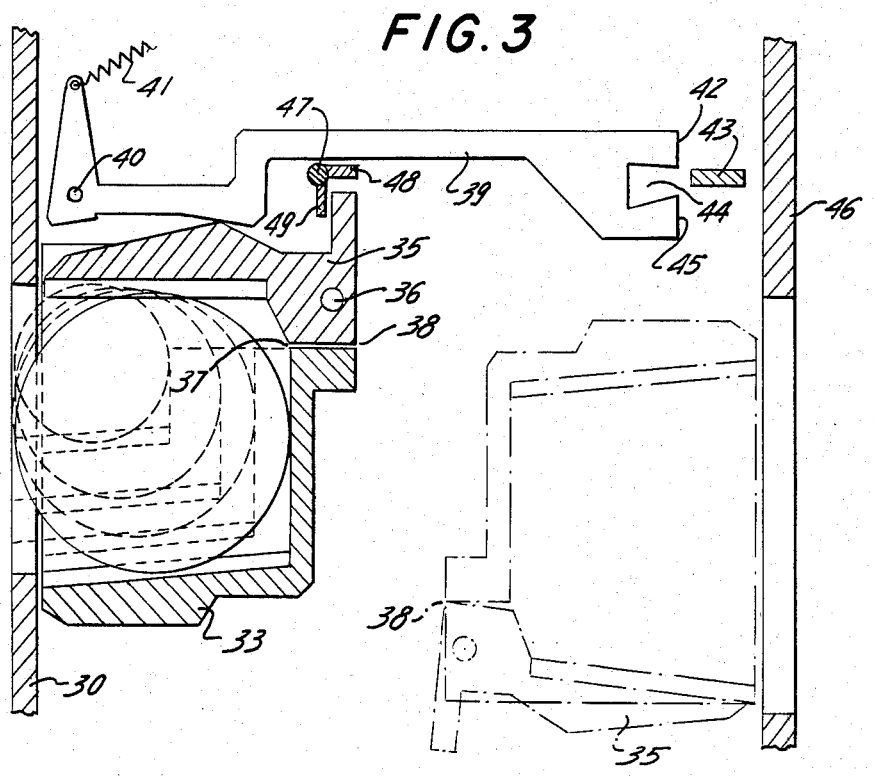
FIG. 3 is a representational cross-sectional detailed side view with the receiving slots for the coins, the calipering mechanism, and with the relocation of the coin housing for emptying coins shown in phantom.

In FIGS. 2 and 3 the construction and operation of the coin housing and calipering mechanism are shown. A coin enters the front plate 30 into a coin housing having coin receiving slots formed by sidewalls 34, a lower "vee" shaped guide 33 and upper "vee" shaped guide 35. As shown in FIG. 3 the lower "vee" shaped guide 33 also serves as rear closure and limits the depth of insertion of the coins. By varying the dimensions of the lower guide 33, the housing can accomodate differently sized coins. While the side walls 34 and the lower guide 33 form a rigid single unit, the upper guide 35 is movable, rotating freely on pivot 36. The rotation of the upper guide is limited by contacting edges 37 and 38. FIG. 3 shows that over each upper guide 35 there is a coin control lever 39 which rotates freely on pivot 40, and, under the tension of spring 41, tends to push the upper guide 35 until contact is made with edge 37. In this condition control lever 39 will have its upper lug 42 in front of the sensor 43. If a proper coin is inserted, the coin will lift upper guide 35 which will, in turn, lift the control lever 39 so that the space 44 between the lugs 42 and 45 will be facing sensor 43. This determines acceptance of the coin in that slot of the coin housing. If a coin or a slug, that does not have the same thickness and diameter dimensions as the proper coin, is inserted, it will cause either lug 42 or lug 45 to be facing sensor 43 thus preventing actuation and causing rejection of the improper coin or slug. FIG. 3 also shows in dotted lines the coin housing after being transported toward the backplate 46 and rotated 180°. It is then in position to release the coins into a coin box or receptacle in the basic machine being actuated. The upper guide 35 has now become a lower guide after it has rotated until contact is made at edge 38 thereby providing an inclined surface for the coin to easily roll down under its own weight.

Since the movement of upper guide 35 is small due to its motion limitation by edges 37 and 38, if the coin inserted into the slot is not sufficiently large to lift the upper guide 35, then there is nothing to retain the coin, and since the lower guide 33 is inclined to the front, the coin will roll out of the slot. The coin release feature is accomplished by rotating lever 47 counterclockwise so that its extention 48 can lift control lever 39 and extension 49 can rotate the upper guide 35. The coin is now free to roll out of the slot. Rotation of lever 47 is accomplished by pulling lever 32 shown in FIGS. 1 and 8. For actuation of the machine the control lever 39 of each slot requiring a coin must be raised into a position of non-interference with sensor 43.

The coin housing is supported on the two side support plates 50 and 51 by means of shaft 52, FIGS. 8 and 9, which extends from both ends of the coin housing through elongated space 53 and 54 in side supports 50 and 51. Both ends of shaft are connected to "U" frame 55. The coin housing can rotate freely on frame 55. However, if the coin housing is pushed into the coin chute assembly, frame 55 will move with it. The rear platform 56 of frame 55 is the means by which the coin chute turns on whatever machine it is operating.

The rotation of the coin housing is controlled by the pinion 57 constantly engaged with rack 58.

Figure 10:
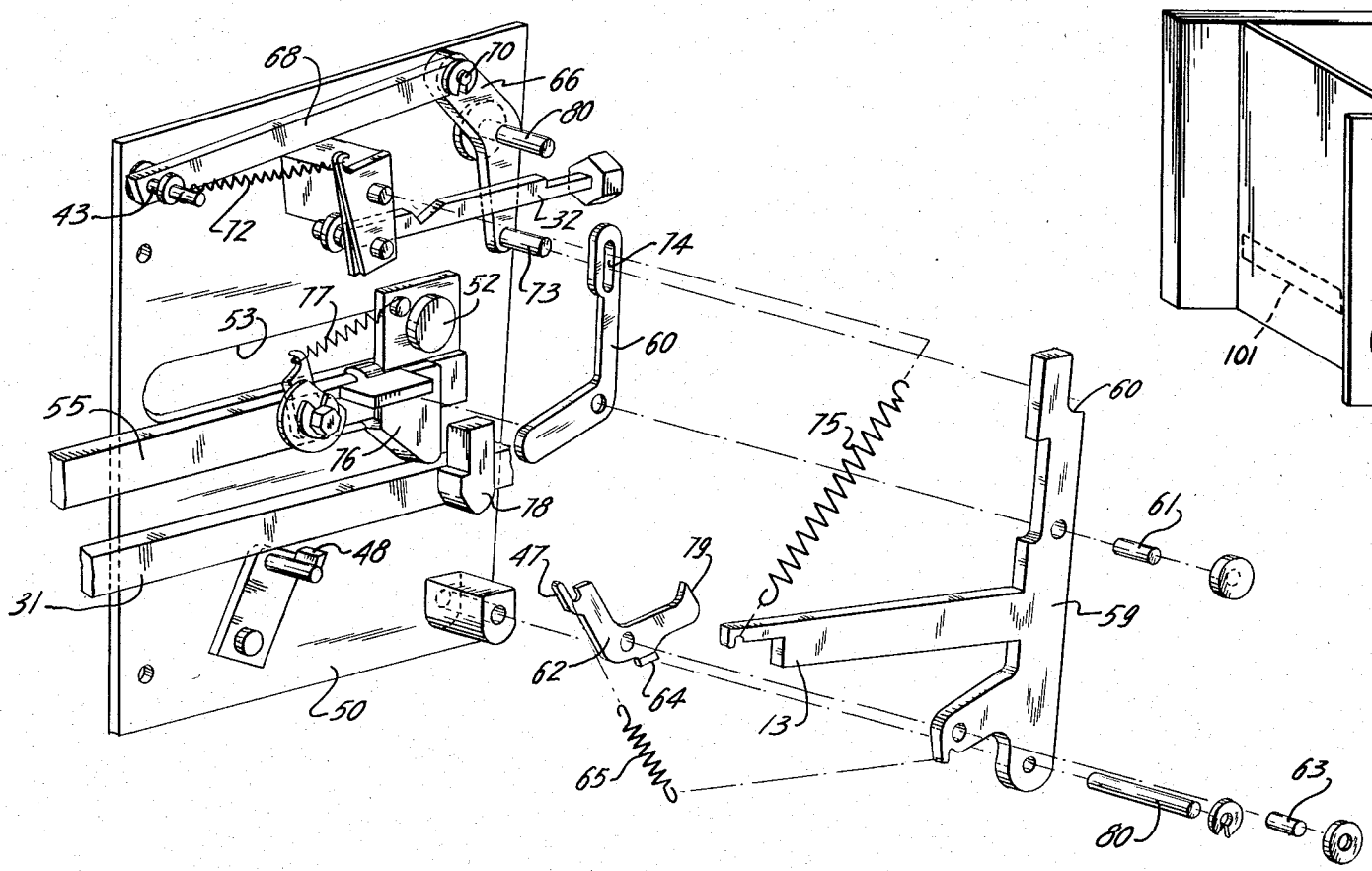
FIG. 10 is an exploded view of the front left hand side of the coin chute.

To actuate the coin chute it is necessary to push plunger 31, FIG. 8. Lever 59 supports lever 60, which can rotate freely on its pivot 61, and lever 62 which, while free to rotate on its pivot 63, has its rest position defined by lug 64 resting against lever 59 under the tension of spring 65. Sensor 43, in addition to being guided on both side support plates 50 and 51, FIGS. 8 and 9, is connected with levers 66 and 67 through links 68 and 69 and pivots 70 and 71. Levers 66 and 67 are both fixed to shaft 80. Spring 72 FIGS. 8 and 10 provides motion to sensor 43. Stud 73, fixed to lever 66 is located inside the eyelet 74 of lever 60 also rests against lever 59. Spring 75 being stronger than spring 72 then defines the position of sensor 43. The left side of frame 55 supports lever 76 which under the tension of spring 77, rests in the path of extension 78 of plunger 31. Whenever plunger 31 is pushed, its extension 78 will first contact surface 79 of lever 62 mounted on lever 59 thereby compelling lever 59 to rotate counterclockwise on its pivot 80 until surface 47 of lever 62 contacts fixed lug 48 at which point lever 62 is compelled to rotate clockwise until its surface 79 disengages from extension 78. As lever 59 begins to move, stud 73 (and, therefore, sensor 43) under the tension of spring 72 attempts to follow lever 59. If sensor finds no obstacles in its path, such as the lugs 42 or 45 of FIG. 3, stud 73 can follow lever 59, therefore lever 60 will maintain its relative position with respect to lever 59. As a consequence lever 76 will not be disturbed and since it is normally in the way of extension 78 of plunger 31, it will be pushed all the way until the coin housing has been rotated due to the interaction of pinion 57 and rack (FIG. 9). When the coin housing was rotated 180°, the coins will be released into a coin receptacle and the machine will be actuated. If sensor 43 finds an obstacle in its path (lug 42 or 45 of any of the control levers 39) then stud 73 cannot follow lever 59, consequently as lever 59 continues to rotate pushed by extension 78, plunger 31 compels lever 60 to rotate clockwise thereby rotating lever 76 counterclockwise. Therefore extension 78 of plunger 31 will not find lever 76 in its path and the coin housing will remain in its original rest position. The disengagement of surface 79 of lever 62 from extension 78 must occur after extension 78 has either already missed or began pushing lever 76. Once lever 62 is disengaged from extension 78, levers 59, 60, 66, and sensor 43 will return to their rest positions. The invention thus not only accomodates a large number of coins but also sensitively discriminates them all. Unless and until the coins are accepted, they remain in full view of the user of the machine.

The fact that plunger 31 travels the same distance regardless of whether the coins are accepted or rejected allows for the possibility of having an electrical drive for translating the plunger rather than manual operation. In this case no part of the plunger would be exposed to the user; however the front plate could have as one possibility a pushbutton switch which would be pressed after having inserted all the required coins.

Figure 11:
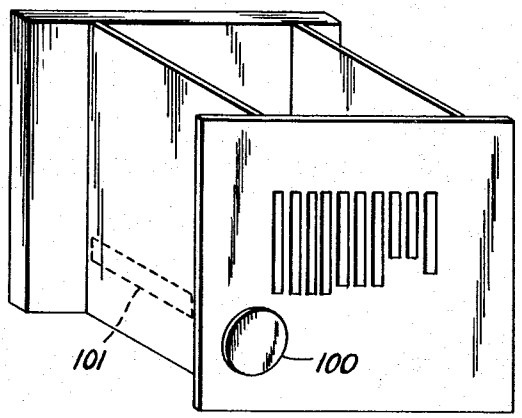
FIG. 11 is a perspective view of the coin chute illustrating where the pushbutton and electrical linear actuator are located on the electric drive units.

The pushbutton switch 100 and electrical linear actuator 101 shown in FIG. 11 replace the manual plunger shown in FIG. 8.

Figure 4:
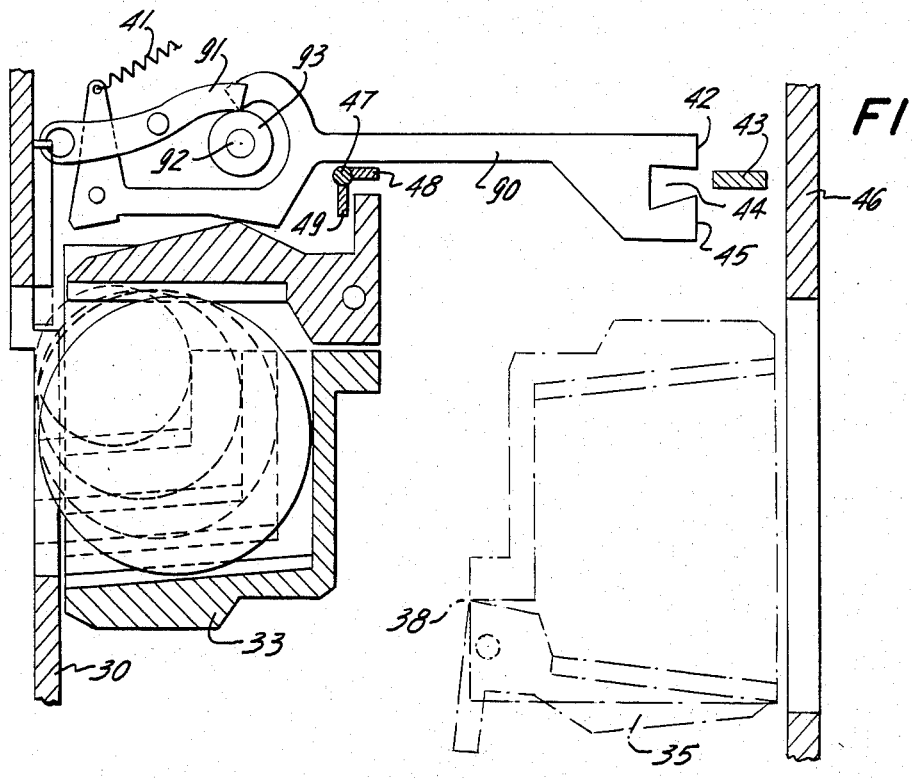
FIG. 4 is a representational cross-sectional side view detailing an alternate construction allowing user to set a specific combination of coins for a varied mode of machine operation.
Figure 5:
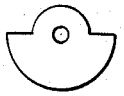
FIGS. 5, 6, and 7 are cross-sectional view of cams for setting sensors at required locations for specific combinations of coins for the alternative shown in FIG. 4.
Figure 6:
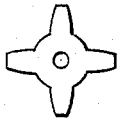
Figure 7:
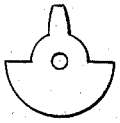

A construction modification allows the coin chute to be set by the user of the machine to one of two or more pre-set combinations of coins depending on the type of operation the user desires from the machine. Thus in an automatic clothes washer, one may wish a hot water wash, followed by a warm water rinse and two additional rinses which would be more expensive than a cold water wash and cold water rinse. In this variation, the control lever 39 FIG. 3 is replaced by the control lever 90 FIG. 4, lever 91, shaft 92, and cam 93. The cams can have various shapes, as shown for example in FIGS. 5, 6, and 7. Which of the various shapes is used to control each control lever 90 will depend on the pre-set combinations of coins desired. By rotating shaft 92 to a set angular rotation, a cam for each coin slot in the coin housing will either neutralize the control lever thus not requiring a coin in that slot or necessitating a coin for machine actuation. When a high spot on the cam lifts the control lever so that the opening 44 between lugs 42 and 45 faces sensor 43, lever 91 is also rotated counterclockwise causing slide 94 to block the coin slot which does not in this instance require a coin. The use of such cams also allows the machine owner to set and then externally change the required coin combination.

While there has been described what are, at present, considered to be the preferred embodiments of the invention, it will be obvious to those skilled in the art that various changes and modifications may be made therein, without departing from the invention, and it is, therefore, aimed in the appended claims to cover all such changes and modifications as fall with the true spirit and scope of the invention.

I claim:

1. An improved coin chute of the type which accepts a set combination of coins, calipers said coins and actuates a coin-operated machine such as a clothes washer or dryer, wherein the improvement comprises a coin housing having a multiplicity of coin receiving slots up to ten or more allowing said machine actuation by any set amount from five cents to ten dollars or more; said coin housing pivotally mounted on a movable frame wherein the transfer of coins to a cash receptacle acheived by a combined linear translation motion and a rotational motion of said coin housing followed by gravity drop of the coins; said coin receiving slots calipering coins for acceptability; means for releasing coins when set amount of coins not satisfied with all acceptable coins; and means for actuating the machine.

2. The coin chute according to claim 1 wherein the coins are calipered by diameter and thickness by said coin receiving slots which comprise fixed lower "vee" shaped guides, side walls, and pivoted upper "vee" guides all of whose positions are dependent upon combined thickness and diameter of coins, and sensor means to determine when said upper guides in the correct position.

3. The coin chute according to claim 1 wherein the means for transferring the coins to the cash receptacle and actuating said machine when the required acceptable coins have been inserted into said coin receiving slots comprises an electrical drive.

4. The coin chute according to claim 1 wherein said means for releasing coins is combined in one operator with said means for actuating the machine.

5. The coin chute according to claim 1 wherein the coins remain in full view of the user until and unless the coins have been accepted by the chute through the calipering and transferred to the coin receptacle.

6. An improved coin chute of the type which accepts a set combination of coins, calipers said coins and actuates a coin-operated machine such as a clothes washer or dryer wherein the improvement comprises a coin housing having a multiplicity of coin receiving slots up to ten or more; means for user to set the coin combination required to one of two or more pre-set combinations depending on the service required from the machine; means for transferring said set combination of coins to a cash receptacle; and means for actuating the machine in user desired mode.

7. An improved coin chute of the type which accepts a set combination of coins, calipers said coins and actuates a coin-operated machine such as a clothes washer or dryer wherein the improvement comprises a coin housing having a multiplicity of coin receiving slots up to ten or more; means for accepting or rejecting coins; means for machine owner to set and then externally change the required coin combination; means for transferring the coins to a cash receptacle; and means for actuating the machine.

* * * * *